US010651595B2

(12) United States Patent
Yamane et al.

(10) Patent No.: US 10,651,595 B2
(45) Date of Patent: May 12, 2020

(54) LEVER ACTUATED CONNECTOR AND CONNECTOR ASSEMBLY

(71) Applicant: Tyco Electronics Japan G.K., Kanagawa (JP)

(72) Inventors: Tomokazu Yamane, Kanagawa (JP); Seiji Komatsu, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 82 days.

(21) Appl. No.: 16/124,603

(22) Filed: Sep. 7, 2018

(65) Prior Publication Data

US 2019/0081438 A1 Mar. 14, 2019

(30) Foreign Application Priority Data

Sep. 8, 2017 (JP) ..... 2017-173087

(51) Int. Cl.
*H01R 13/62* (2006.01)
*H01R 13/64* (2006.01)
(Continued)

(52) U.S. Cl.
CPC ..... *H01R 13/62933* (2013.01); *H01R 13/44* (2013.01); *H01R 13/506* (2013.01); *H01R 13/62938* (2013.01); *H01R 13/7031* (2013.01)

(58) Field of Classification Search
CPC ..... H01R 13/62933; H01R 13/62938; H01R 13/62955; H01R 13/514; H01R 4/4836;
(Continued)

(56) References Cited

U.S. PATENT DOCUMENTS 5,516,300 A * 5/1996 Tsuji ..... H01R 13/701 200/51 R
7,670,158 B2 3/2010 Morie et al.
(Continued)

FOREIGN PATENT DOCUMENTS

EP 2843773 A1 3/2015
EP 2988375 A1 2/2016
(Continued)

OTHER PUBLICATIONS

Extended European Search Report, European Patent Application No. 18193033.0, dated Jan. 24, 2019, 11 pages.
(Continued)

*Primary Examiner* — Abdullah A Riyami
*Assistant Examiner* — Thang H Nguyen
(74) *Attorney, Agent, or Firm* — Barley Snyder

(57) ABSTRACT

A plug connector is detachably matable with a cap connector. The plug connector includes a lever performing mating with and unmating from the cap connector. The lever includes a cam groove for receiving a first boss of the cap connector, a boss rotation hole for receiving a second boss of an outer housing of the plug connector, and a catching protrusion sliding hole for receiving a catching protrusion of an inner housing of the plug connector. A first turning operation of the lever during unmating from a fully mated state extracts an interlock busbar of the plug connector from the cap connector to remove a short circuit of first conducting wires of the cap connector. A second turning operation of the lever during unmating moves a releasing protrusion into a clip spring of the plug connector to open the clip spring.

10 Claims, 18 Drawing Sheets

(51) Int. Cl.

| | |
|---|---|
| ***H01R 29/00*** | (2006.01) |
| ***H01R 13/629*** | (2006.01) |
| ***H01R 13/703*** | (2006.01) |
| ***H01R 13/44*** | (2006.01) |
| ***H01R 13/506*** | (2006.01) |

(58) Field of Classification Search
CPC ... H01R 13/44; H01R 3/62933; H01R 13/506
USPC ..... 439/157, 372, 188
See application file for complete search history.

(56) References Cited

U.S. PATENT DOCUMENTS

| | | | | |
|---|---|---|---|---|
| 8,986,024 | B2 | 3/2015 | Ikeda et al. | |
| 9,048,045 | B2 | 6/2015 | Henmi | |
| 9,716,341 | B2 * | 7/2017 | Yamane | H01R 13/703 |
| 9,966,701 | B2 * | 5/2018 | Tabata | H01R 13/62933 |
| 2002/0173185 | A1 * | 11/2002 | Fukushima | H01R 13/62938 439/157 |
| 2008/0233778 | A1 * | 9/2008 | Moll | H01R 13/7032 439/188 |
| 2011/0117761 | A1 | 5/2011 | Loncar et al. | |
| 2015/0229080 | A1 * | 8/2015 | Degen | H01R 24/22 439/43 |
| 2017/0133790 | A1 | 5/2017 | Yamane et al. | |

FOREIGN PATENT DOCUMENTS

| | | | |
|---|---|---|---|
| JP | 2003100383 | A | 4/2003 |
| JP | 2003100385 | A | 4/2003 |
| JP | 2012119292 | A | 6/2012 |
| JP | 2012243559 | A | 12/2012 |
| JP | 201362042 | A | 4/2013 |
| JP | 201791805 | A | 5/2017 |

OTHER PUBLICATIONS

Abstract of JP2012243559, dated Dec. 10, 2012, 1 page.
Abstract of JP2003100385, dated Apr. 4, 2003, 1 page.
Abstract of JP2003100383, dated Apr. 4, 2003, 1 page.

* cited by examiner

LEVER ACTUATED CONNECTOR AND CONNECTOR ASSEMBLY

CROSS-REFERENCE TO RELATED APPLICATION

This application claims the benefit of the filing date under 35 U.S.C. § 119(a)-(d) of Japanese Patent Application No. 2017-173087, filed on Sep. 8, 2017.

FIELD OF THE INVENTION

The present invention relates to a connector and, more particularly, to a lever actuated connector.

BACKGROUND

A battery mounted on an electric vehicle or a hybrid vehicle, for example, is mounted with a service plug for interrupting electrical conduction between a power supply in the battery and a load composed of an electrical system in the vehicle. This service plug is a connector for ensuring working safety during maintenance of the electrical system in the vehicle.

A service plug disclosed in Japanese Patent Application No. 2013-62042A includes a cap connector connected to the power supply side and a plug connector mated with the cap connector and capable of being unmated from the cap connector. During maintenance of the electrical system in the vehicle, the plug connector is detached from the cap connector. Accordingly, power fed to the electrical system in the vehicle is interrupted and the safety of an operator is ensured.

In order to detach the plug connector disclosed in JP 2013-62042A, two operations using separate parts, releasing a catch made by a catching arm and turning a lever, are required to be performed in cooperation. The operator, however, generally wears gloves, and performing these two operations in cooperation is difficult.

SUMMARY

A plug connector is detachably matable with a cap connector. The plug connector includes a lever performing mating with and unmating from the cap connector. The lever includes a cam groove for receiving a first boss of the cap connector, a boss rotation hole for receiving a second boss of an outer housing of the plug connector, and a catching protrusion sliding hole for receiving a catching protrusion of an inner housing of the plug connector. A first turning operation of the lever during unmating from a fully mated state extracts an interlock busbar of the plug connector from the cap connector to remove a short circuit of first conducting wires of the cap connector. A second turning operation of the lever during unmating moves a releasing protrusion into a clip spring of the plug connector to open the clip spring.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
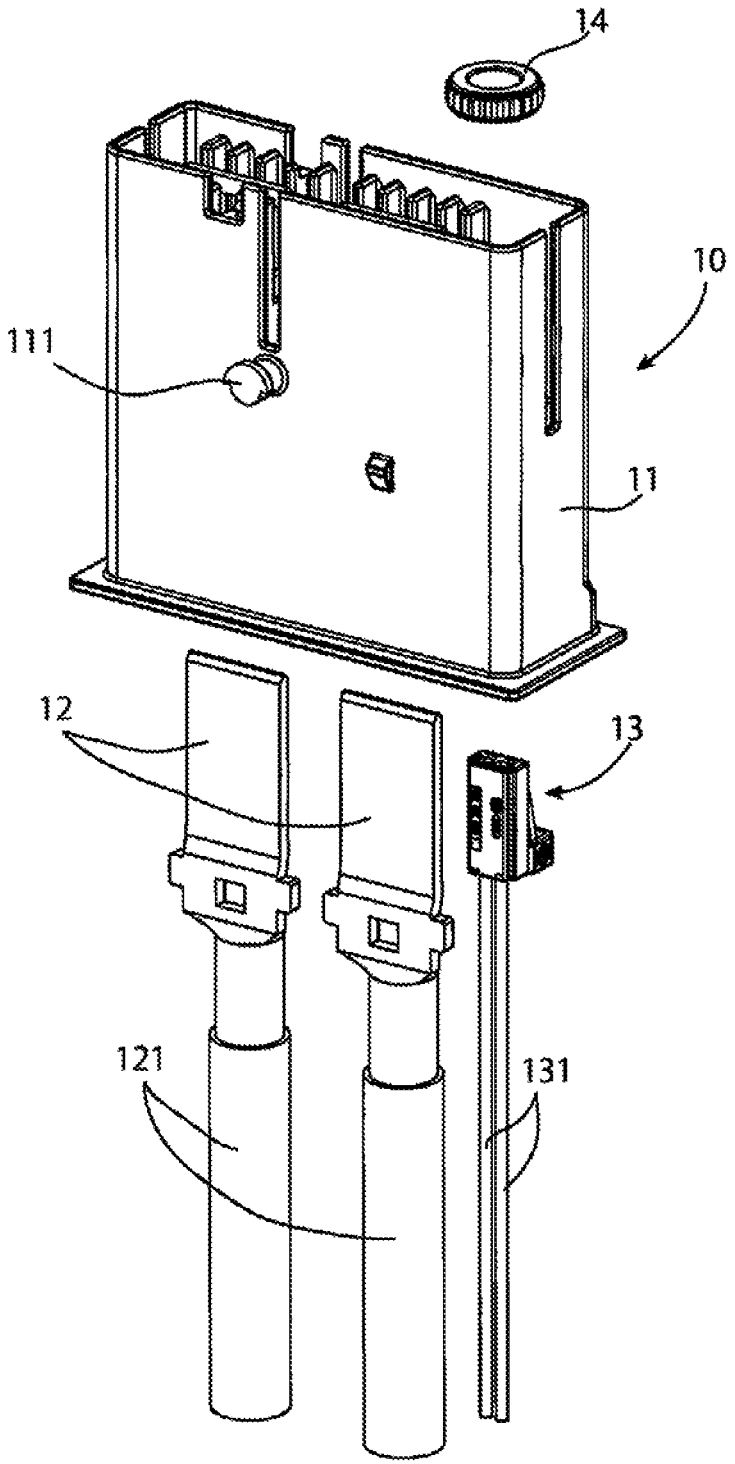
FIG. 1 is an exploded perspective view of a cap connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2A:
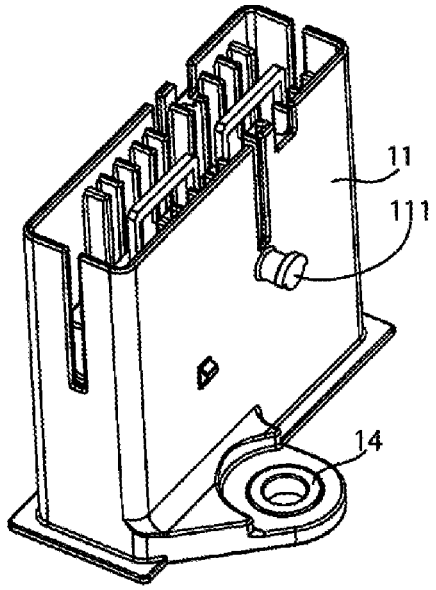
FIG. 2A is a perspective view of the cap connector with a collar attached to a housing of the cap connector.
Figure 2B:
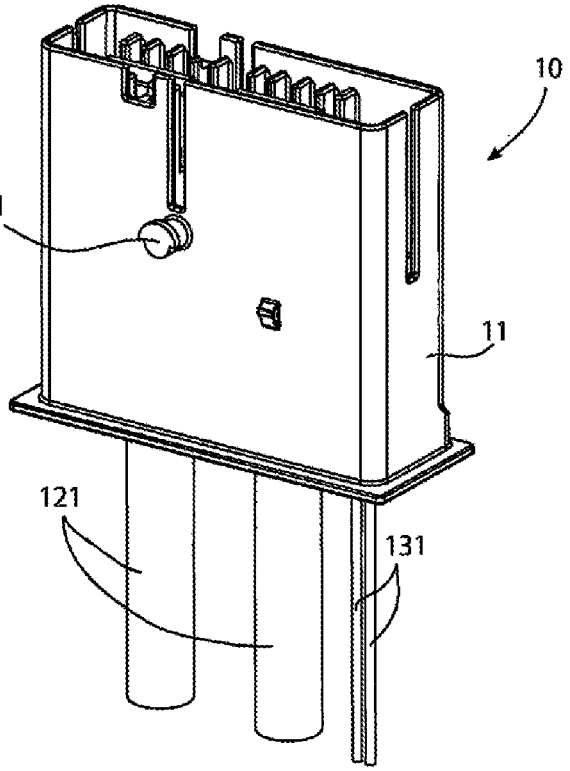
FIG. 2B is a perspective view of the cap connector assembled.

A cap connector 10 according to an embodiment is shown in FIGS. 1, 2A, and 2B. The cap connector 10 may also referred to as a mating connector or a first connector throughout the specification.

The cap connector 10, as shown in FIG. 1, has a housing 11, a pair of terminals 12, an interlock connector 13, and a collar 14. The pair of terminals 12 are fixed to respective ends of two second conducting wires 121 for power transfer. The interlock connector 13 retains ends of two first conducting wires 131 for signal transmission. A pair of first bosses 111 individually protruding from outer wall faces on both sides of the housing 11 are provided on the housing 11.

As shown in FIG. 2A, the collar 14 is press-fit in the housing 11. In the shown embodiment, the collar 14 is a screw hole for installation of the cap connector 10. As shown in FIG. 2B, the pair of terminals 12 and the interlock connector 13 are accommodated in the housing 11 when the cap connector 10 is fully assembled.

The cap connector 10 is a connector to be installed on a battery (power supply) side of an electric vehicle or a hybrid vehicle. The cap connector 10 is configured to be mated with a plug connector 20 described in greater detail below. The plug connector 20, at the time of mating with the cap connector 10, first short-circuits the pair of terminals 12, and thereafter short-circuits the two conducting wires 131 of the interlock connector 13. In addition, the plug connector 20, at the time of unmating from the cap connector 10, first, removes the short circuit of the two conducting wires 131 of the interlock connector 13. Then, after the lapse of a predetermined period of time, the short circuit of the pair of terminals 12 is removed. By unmating the plug connector 20 from the cap connector 10, power feeding from the battery (power supply) to an electrical system (load) of the vehicle is shut off.

The plug connector 20 is shown in FIGS. 3-7C. The plug connector 20 may also be referred to as a connector or a second connector throughout the specification.

Figure 3:
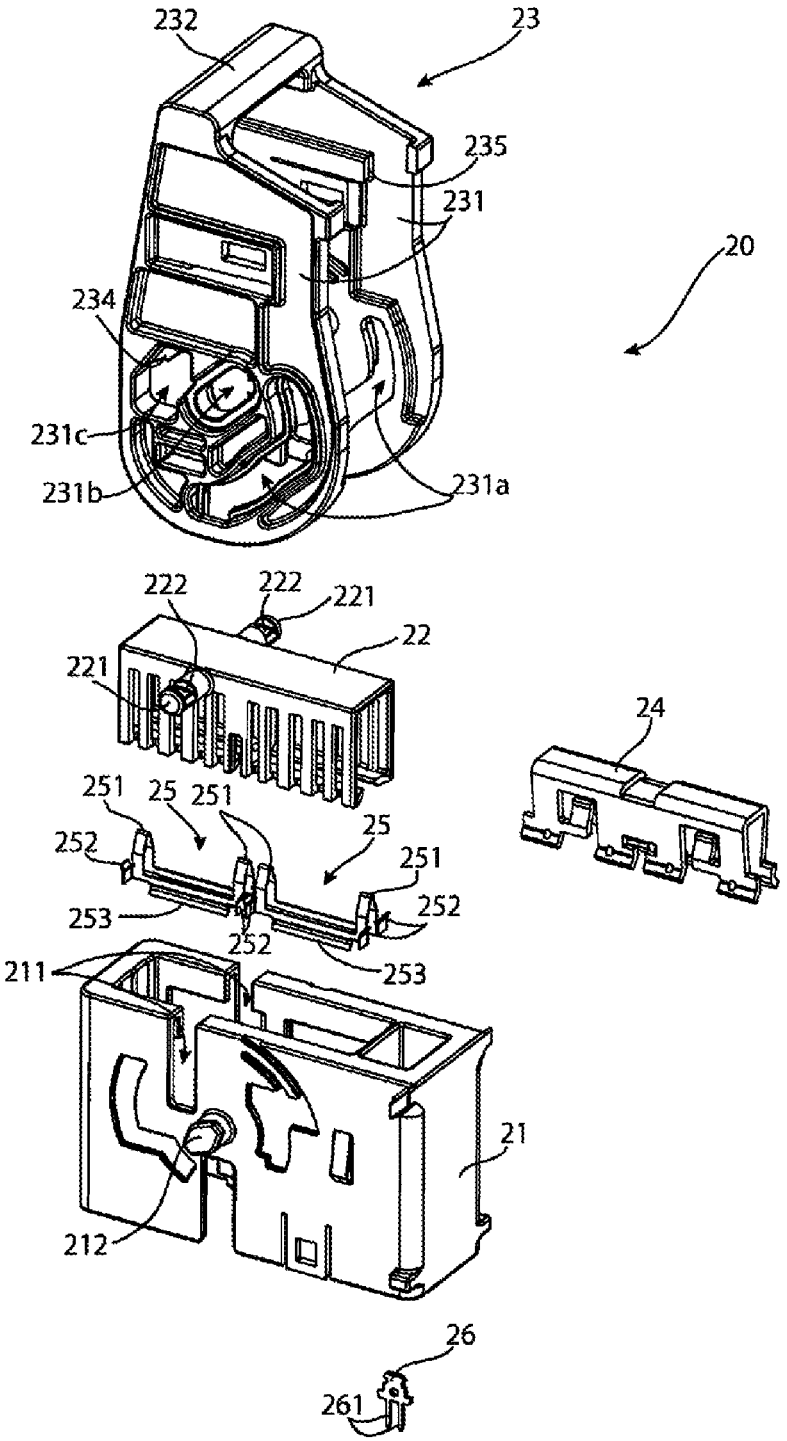
FIG. 3 is an exploded perspective view of a plug connector according to an embodiment.

The plug connector 20, as shown in FIG. 3, includes an outer housing 21, an inner housing 22, a lever 23, a clip spring 24, two wiping contacts 25, and an interlock busbar 26. The clip spring 24 functions to elastically pinch and short-circuit the pair of terminals 12 of the cap connector 10. The two wiping contacts 25 function to wipe dust off each of the pair of terminals 12 when the plug connector 20 is mated with the cap connector 10. The interlock busbar 26 functions to short-circuit the two conducting wires 131 by two male contact portions 261 thereof being inserted into the interlock connector 13 at the time of mating.

The inner housing 22 retains the clip spring 24. A pair of catching protrusions 221 individually protrude outward from both lateral sides of the inner housing 22, as shown in FIG. 3. These catching protrusions 221 are formed with catching grooves 222. The inner housing 22 is so accommodated in the outer housing 21 as to be movable in a mating/unmating direction (vertically in FIG. 3) with respect to the outer housing 21 while retaining the clip spring 24.

As shown in FIG. 3, the outer housing 21 is formed with a pair of grooves 211 allowing the catching protrusions 221 of the inner housing 22 to protrude outward therethrough. In addition, a pair of second bosses 212 individually protrude from outer wall faces on both sides of the outer housing 21. The wiping contacts 25 and the interlock busbar 26 are also accommodated in the outer housing 21. The clip spring 24, before the initiation of mating, is opened to such an extent as to receive the terminals 12 shown in FIG. 1 by releasing protrusions 214 of the outer housing 21, shown in FIG. 4A, being located in the clip spring 24.

The lever 23, as shown in FIG. 3, has a pair of cam plates 231 that are mirror images of each other and a beam portion 232 connecting the cam plates 231. Each of the cam plates 231 is positioned along one of the side faces of the outer housing 21. Each of the cam plates 231 has a cam groove 231*a*, a boss rotation hole 231*b*, and a catching protrusion sliding hole 231*c*. The first boss 111 of the housing 11 of the cap connector 10 is positioned in the cam groove 231*a*. The second boss 212 of the outer housing 21 of the plug connector 20 is positioned in the boss rotation hole 231*b*. Further, the catching protrusion 221 of the inner housing 22 protruding from the groove 211 of the outer housing 21 is positioned in the catching protrusion sliding hole 231*c*. A catching rib 234 is provided on each of the pair of cam plates 231 as to protrude into the catching protrusion sliding hole 231*c*. The catching rib 234 extends into the catching groove 222 formed in the catching protrusion 221 of the inner housing 22.

Figure 4A:
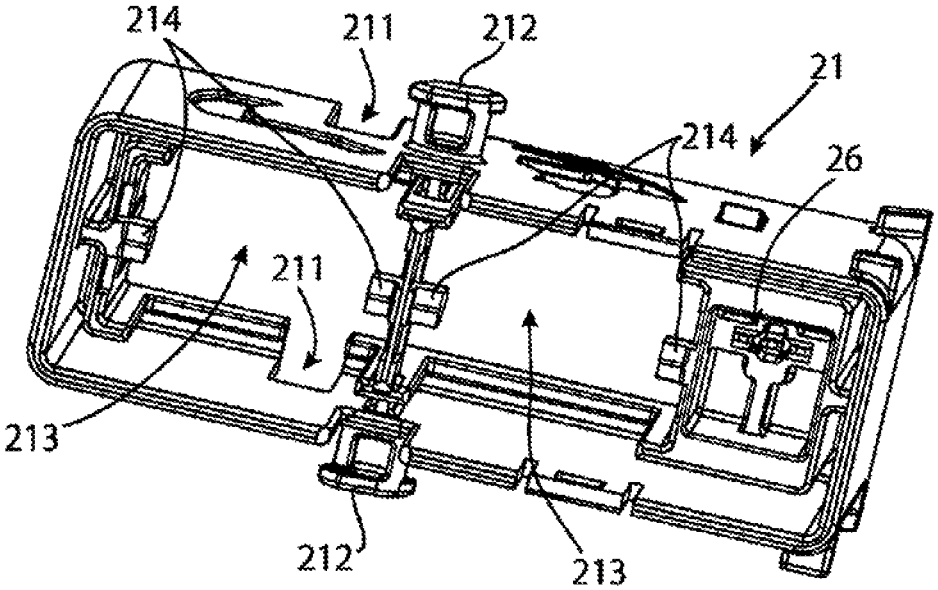
FIG. 4A is a bottom perspective view of an initial stage of assembly of the plug connector.

The lever 23 is operated in the mating direction. During operation of the lever 23, the pair of terminals 12 received in the clip spring 24 opened by the releasing protrusions 214 shown in FIG. 4A are first pinched by the clip spring 24, which causes the pair of terminals 12 to short-circuit. Then, with further mating operation after this pinching, the male contact portions 261 of the interlock busbar 26 are inserted into the interlock connector 13 to short-circuit the two conducting wires 131. From a fully mated state, the lever 23 is operated in the unmating direction. Thereupon, the interlock busbar 26 is first pulled out from the interlock connector 13 to remove the short circuit of the two conducting wires 121. Thereafter, the releasing protrusions 214 are inserted into the clip spring 24 to open the clip spring 24 and the pair of terminals 12 can now be easily extracted from the clip spring 24.

Figure 4B:
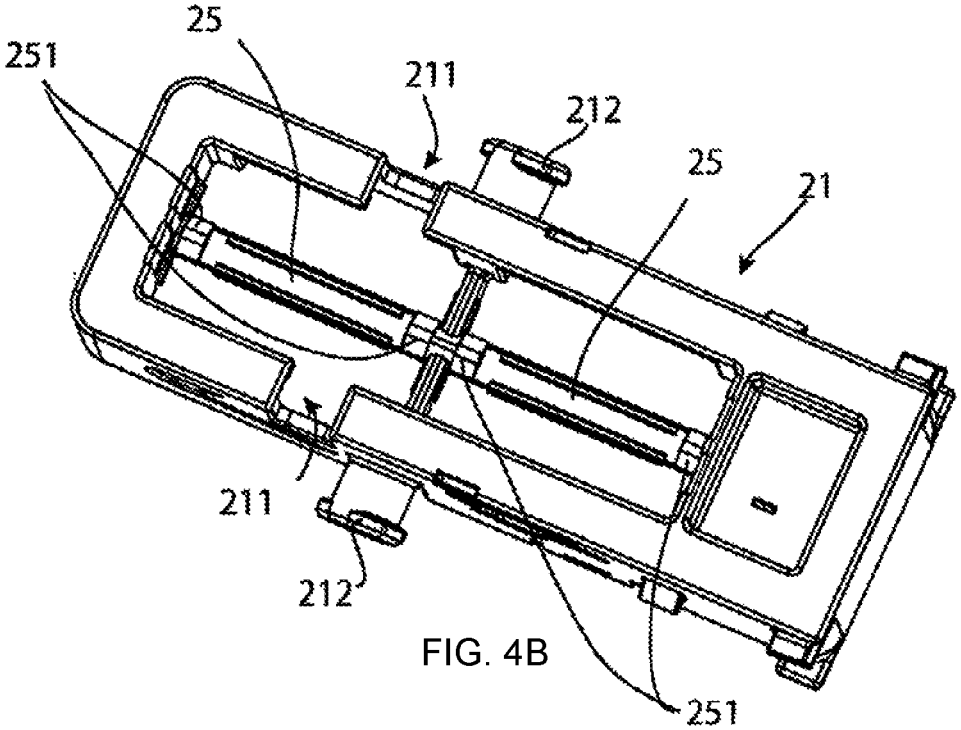
FIG. 4B is a top perspective view of the initial stage of assembly of the plug connector.

An initial stage of assembly of the plug connector 20 is shown in FIGS. 4A and 4B.

As shown in FIG. 4A, the interlock busbar 26 is press-fitted in the outer housing 21, with the male contact portions 261 of the interlock busbar 26 oriented in the mating direction. Two opening portions 213 penetrating in the mating direction are provided in the outer housing 21. The releasing protrusions 214 are disposed at both longitudinal ends of each of these two opening portions 213.

As shown in FIG. 4B, the two wiping contacts 25 are disposed in the outer housing 21. Supported portions 251 bent in inverted-V shapes, as shown in FIG. 3, are provided at both ends of each of the two wiping contacts 25. The two wiping contacts 25 are installed in the outer housing 21 in such a manner that the supported portions 251 rest on the releasing protrusions 214 of the outer housing 21. Folded portions 252 folded upward are provided on the wiping contacts 25, as shown in FIG. 3. When the wiping contact 25 is placed on the outer housing 21, the folded portion 252 is hooked on the outer housing 21 to retain the wiping contact 25 in the outer housing 21. A skirt portion 253 flaring obliquely downward in FIG. 3 is provided on the wiping contact 25. The skirt portion 253 is configured to clean the terminal 12 shown in FIG. 1.

Figure 5:
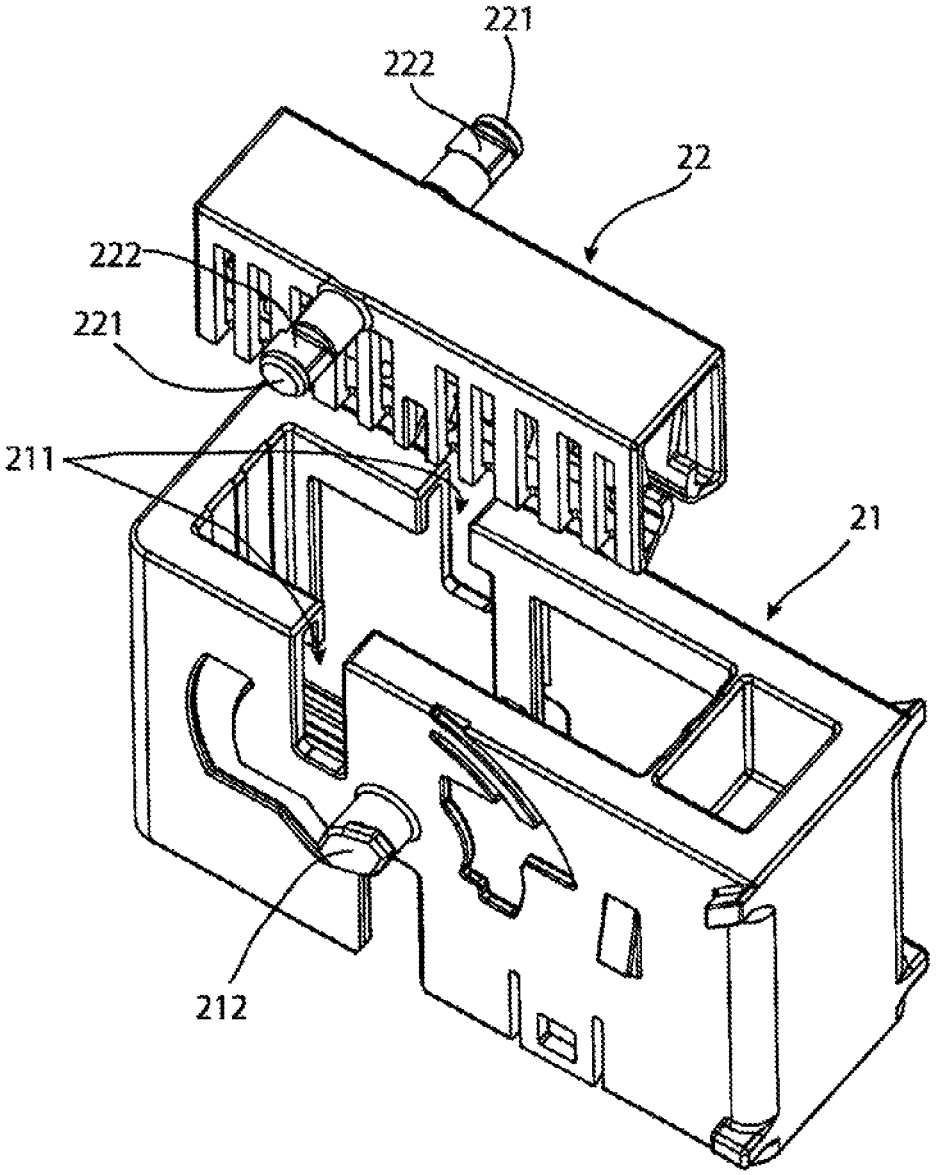
FIG. 5 is an exploded perspective view of a next step of assembly of the plug connector.

After the interlock busbar 26 and the two wiping contacts 25 are incorporated into the outer housing 21, as shown in FIGS. 4A and 4B, the inner housing 22 retaining the clip spring 24 is then accommodated in the outer housing 21, as shown in FIG. 5. The catching protrusions 221 of the inner housing 22 are positioned in the grooves 211 of the outer housing 21.

Figure 6A:
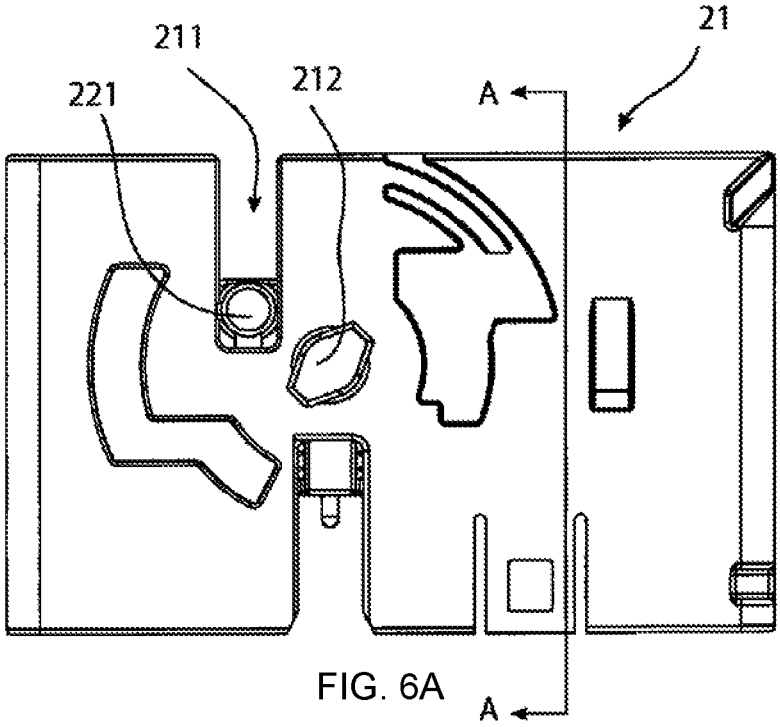
FIG. 6A is a front view of an outer housing of the plug connector with an inner housing of the plug connector disposed in the outer housing.
Figure 6B:
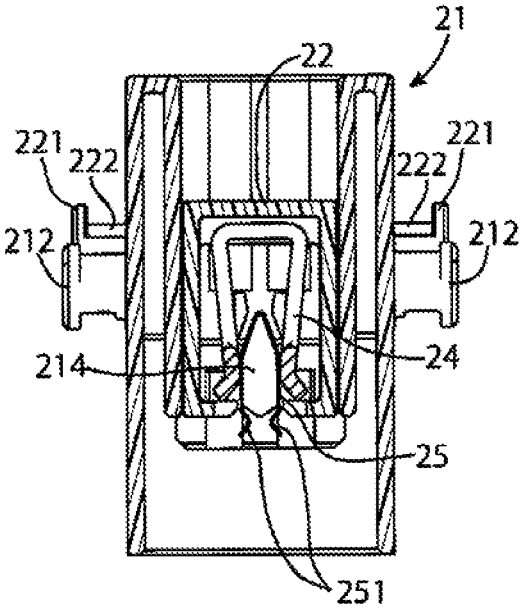
FIG. 6B is a sectional front view of the inner housing in the outer housing taken along line A-A of FIG. 6A.

When the inner housing 22 is accommodated in the outer housing 21, as shown in FIGS. 6A and 6B, the catching protrusions 221 of the inner housing 22 protrude from the grooves 211 of the outer housing 21. In addition, the releasing protrusions 214 of the outer housing 21 extend into the clip spring 24 accommodated in the inner housing 22, and the clip spring 24 is moved into an opened state.

Figure 7A:
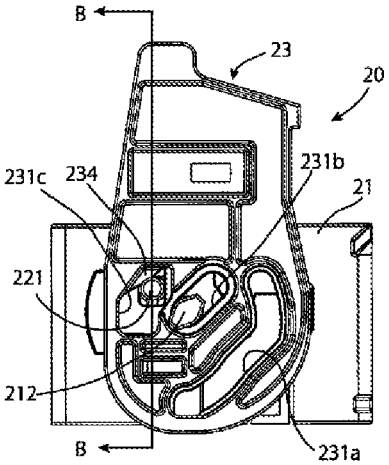
FIG. 7A is a side view of a assembled state of the plug connector with a lever attached thereto.
Figure 7B:
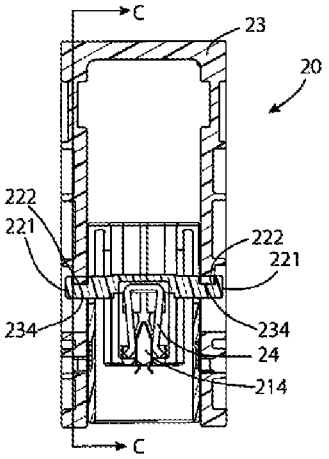
FIG. 7B is a sectional front view of the plug connector taken along line B-B of FIG. 7A.
Figure 7C:
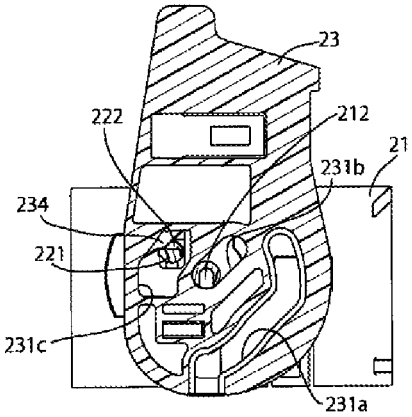
FIG. 7C is a sectional side view of the plug connector taken along line C-C of FIG. 7B.

The lever 23 is placed in a vertically-oriented attitude, as shown in FIGS. 7A-7C, before the mating with the cap connector 10. The second bosses 212 of the outer housing 21 are located in the boss rotation holes 231*b* formed in the cam plates 231 of the lever 23. The catching protrusions 221 of the inner housing 22 are located in the catching protrusion sliding holes 231*c*. The catching ribs 234 of the cam plates 231 are located in the catching grooves 222 provided in the catching protrusions 221. The first bosses 111 of the housing 11 of the cap connector 10 extend into the cam grooves 231*a* at the time of mating. The cam grooves 231*a*, however, are still empty when the plug connector 20 is in a state separated from the cap connector 10.

A sequential mating operation of the plug connector 20 with the cap connector 10 is shown in FIGS. 8A-8E.

Figure 8A:
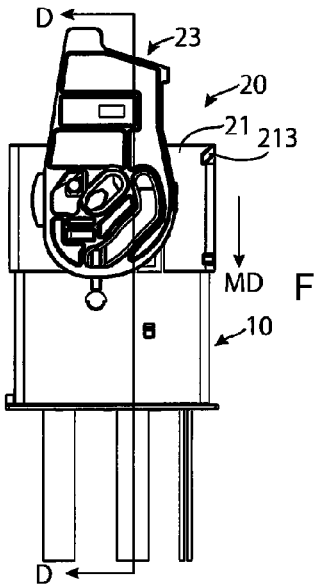
FIG. 8A is a side view of a first step of an operation of mating the cap connector with the plug connector.
Figure 8B:
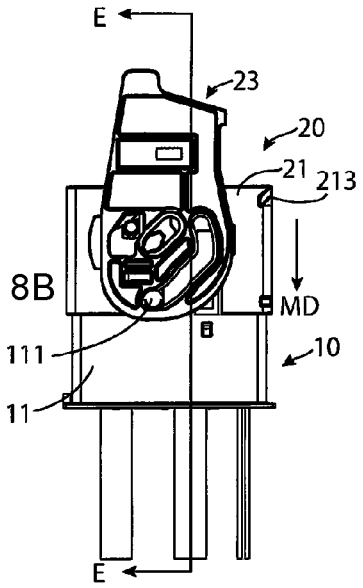
FIG. 8B is a side view of a second step of the operation of mating the cap connector with the plug connector.
Figure 8C:
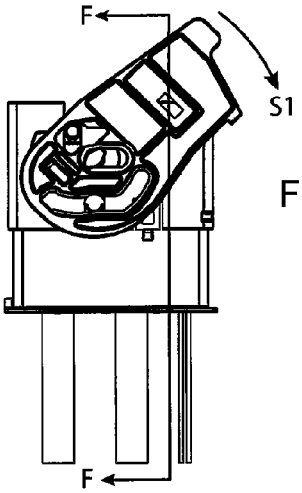
FIG. 8C is a side view of a third step of the operation of mating the cap connector with the plug connector.

The plug connector 20 is placed on the cap connector 10 with the lever 23 in a vertically-oriented attitude, as shown in FIG. 8A, and then moved in the mating direction MD. Thereupon, as shown in FIG. 8B, the first bosses 111 of the housing 11 of the cap connector 10 extend into the cam grooves 231*a*. In that state, the lever 23 is turned by 45 degrees in the direction of an arrow S1, as shown in FIG. 8C. When the lever 23 is turned by 45 degrees, an abutting portion 235 shown in FIG. 3 of the lever 23 abuts on an abutted portion 213 shown in FIGS. 8A and 8B of the outer housing 21 of the plug connector 20. Thereby, the lever 23 can no longer be turned.

Figure 8D:
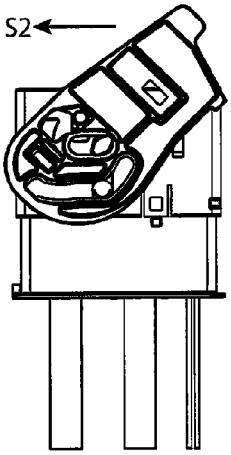
FIG. 8D is a side view of a fourth step of the operation of mating the cap connector with the plug connector.
Figure 8E:
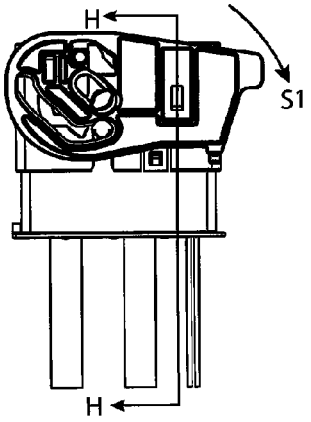
FIG. 8E is a side view of a fully mated state of the cap connector with the plug connector.

Next, the lever 23 is slid in the direction of an arrow S2 shown in FIG. 8D and the abutment of the abutting portion 235 on the abutted portion 213 is released. The lever 23 is then again turned in the direction of the arrow S1 to take an attitude, shown in FIG. 8E, turned by 90 degrees from the attitude shown in FIG. 8A before the turn. This state of the lever 23 turned to the attitude of FIG. 8E is a fully mated state.

Figure 9A:
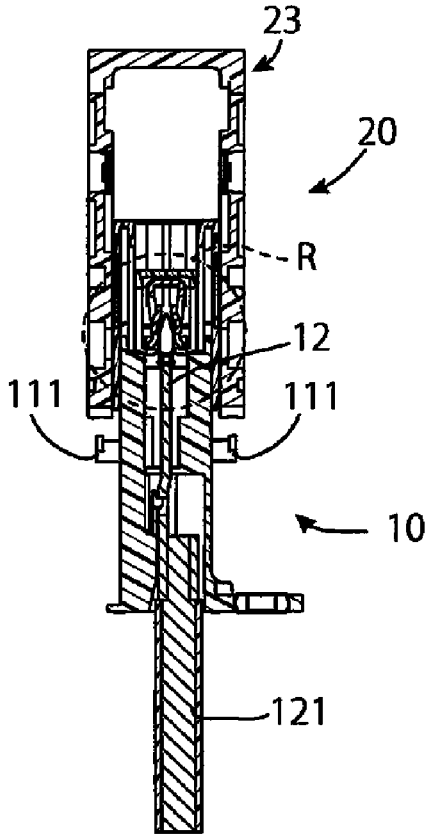
FIG. 9A is a sectional front view of the cap connector and the plug connector at an initiation of mating taken along line D-D of FIG. 8A.
Figure 9B:
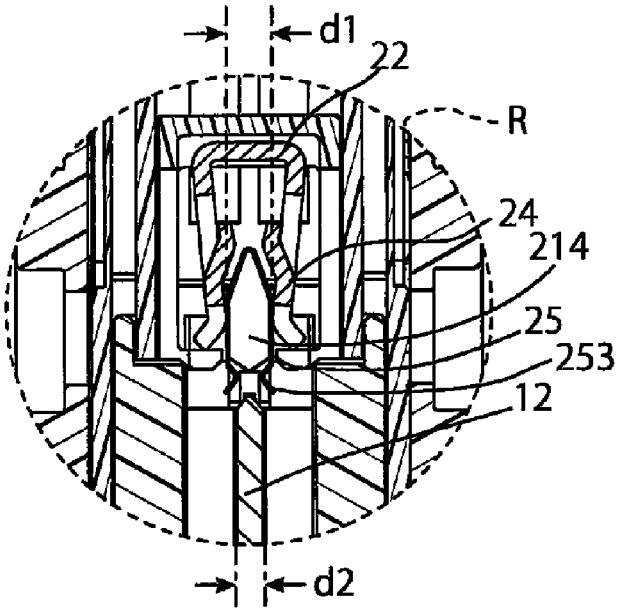
FIG. 9B is a sectional front view of an enlarged portion of FIG. 9A.

An internal state of the plug connector 20 at an initiation of mating is shown in FIGS. 9A and 9B; the state shown here is a state of the plug connector 20 being only positioned on top of the cap connector 10. In this state, as described with reference to FIG. 7B, the releasing protrusions 214 are located with the clip spring 24, pushing the clip spring 24 open. A thickness d1 of the releasing protrusion 214 is thicker than a thickness d2 of the terminal 12 of the cap connector 10. Therefore, the terminal 12 can easily extend into the clip spring 24.

Figure 10A:
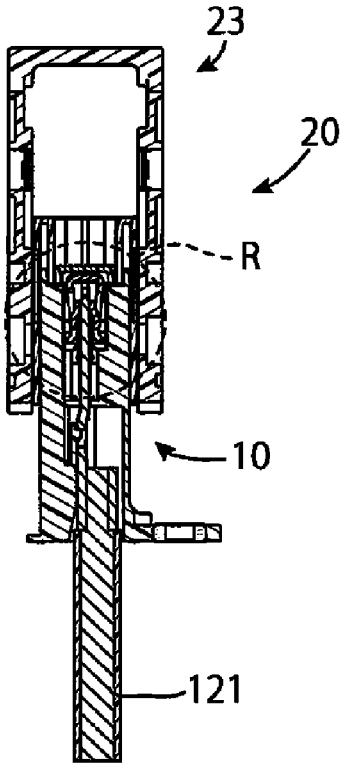
FIG. 10A is a sectional front view of the cap connector and the plug connector in the second step of the operation of mating taken along line E-E of FIG. 8B.
Figure 10B:
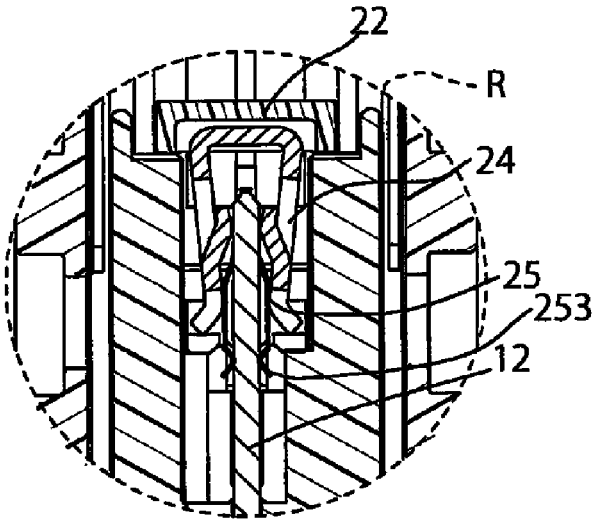
FIG. 10B is a sectional front view of an enlarged portion of FIG. 10A.

The internal state of the plug connector 20 when the first bosses 111 of the housing 11 of the cap connector 10 extend into the cam grooves 231*a* of the lever 23 is shown in FIGS. 10A and 10B; FIG. 10A is a cross-sectional view taken along arrows E-E of FIG. 8B. As shown in FIG. 8B, when the bosses 111 of the housing 11 of the cap connector 10 extend into the cam grooves 231*a* of the lever 23, inside the plug connector 20 the terminals 12 extend into the clip spring 24. The inner housing 22 accommodating the clip spring 24 abuts on the housing 11 of the cap connector 10. As the terminals 12 extend into the clip spring 24, the terminals 12 are cleaned sliding on the skirt portion 253 of the wiping contact 25.

Figure 11A:
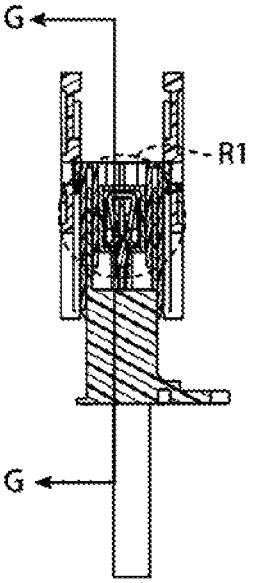
FIG. 11A is a sectional front view of the cap connector and the plug connector in the third step of the operation of mating taken along line F-F of FIG. 8C.
Figure 11B:
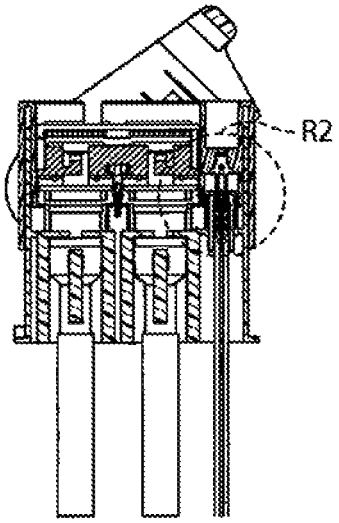
FIG. 11B is a sectional side view of the cap connector and the plug connector in the third step of the operation of mating taken along line G-G of FIG. 11A.
Figure 11C:
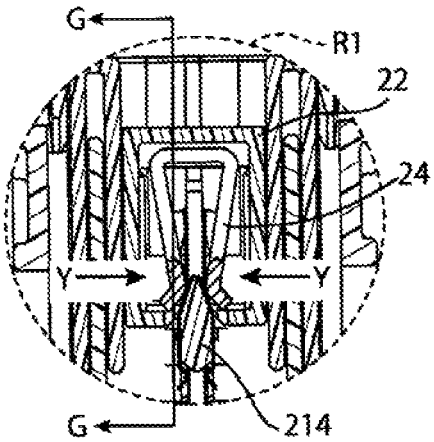
FIG. 11C is a sectional front view of an enlarged portion of FIG. 11A.
Figure 11D:
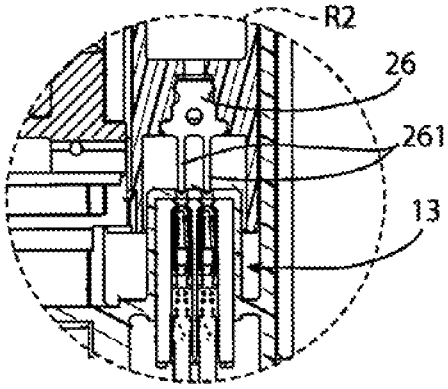
FIG. 11D is a sectional side view of an enlarged portion of FIG. 11B.

The internal state of the plug connector 20 when the lever 23 is inclined at 45 degrees is shown in FIGS. 11A-11D; FIG. 11A is a cross-sectional view taken along arrows F-F shown in FIG. 8C. The lever 23 is turned from the vertically-orientated state shown in FIG. 8A to the 45-degrees inclined state shown in FIG. 8C. Thereupon, the cam action of the cam plates 231 of the lever 23 presses down the outer housing 21 of the plug connector 20 in the mating direction MD with the cap connector 10. However, since the inner housing 22 abuts on the housing 11 of the cap connector 10, the inner housing 22 and the clip spring 24 retained in the inner housing 22 are not pressed down but left behind at that position. Then, as a result of the pressing down of the outer housing 21 with the inner housing 22 left behind, the releasing protrusions 241 are also lowered to slip out of the clip spring 24. Thereupon, the clip spring 24 exerts its spring force to close in the direction of arrows Y shown in FIG. 11C and firmly pinch the terminals 12 with that spring force. The pair of terminals 12 are thereby put into short-circuited states. However, as shown in FIGS. 11B and 11D, the interlock busbar 26 in this stage is still not inserted into the interlock connector 13, and the power to the terminals 12 is still interrupted.

Figure 12A:
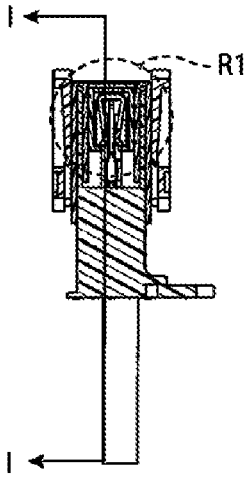
FIG. 12A is a sectional front view of the cap connector and the plug connector in the fully mated state taken along line H-H of FIG. 8E.
Figure 12B:
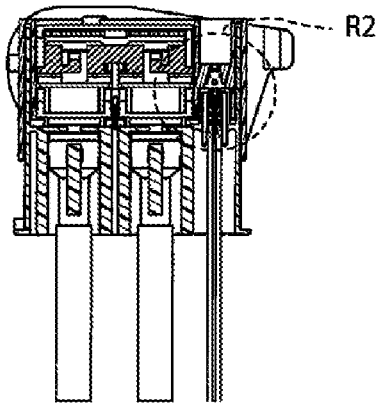
FIG. 12B is a sectional side view of the cap connector and the plug connector in the fully mated state taken along line I-I of FIG. 12A.
Figure 12C:
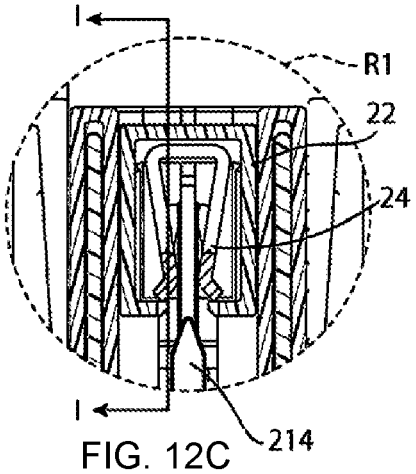
FIG. 12C is a sectional front view of an enlarged portion of FIG. 12A.
Figure 12D:
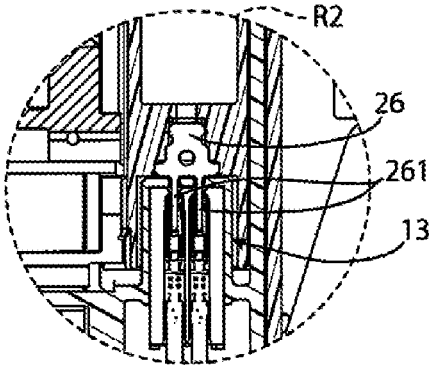
FIG. 12D is a sectional side view of an enlarged portion of FIG. 12B.

The internal state of the plug connector 20 when the lever 23 is inclined at 90 degrees is shown in FIGS. 12A-12D; FIG. 12A is a cross-sectional view taken along arrows H-H shown in FIG. 8E. FIG. 8E represents the fully mated state. As shown in FIG. 8E, the lever 23 is turned at 90 degrees. Thereupon, inside the connector, the clip spring 24 pinches and short-circuits the pair of terminals 12, and the male contact portions 261 of the interlock busbar 26 are inserted into the interlock connector 13 to short-circuit the two conducting wires 131.

A sequential unmating operation of the plug connector 20 from the cap connector 10 is shown in FIGS. 13A-13F.

Figure 13A:
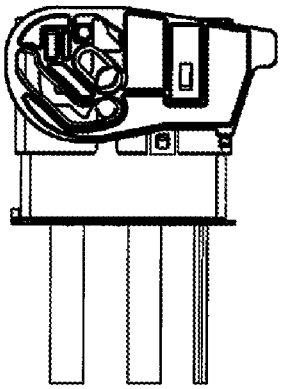
FIG. 13A is a side view of a fully mated state of the cap connector and the plug connector.

The fully mated state in which the lever 23 is positioned at 90 degrees is shown in FIG. 13A. From this state, as the lever 23 is turned in the direction of an arrow S3 shown in FIG. 13B, the outer housing 21 of the plug connector 20 is lifted in the unmating direction with the turn of the lever 23. However, the inner housing 22 is not lifted but stays in that place since the clip spring 24 is pinching the terminals 12 and the lever 23 turns while the catching protrusion 221 of the inner housing 22 is sliding on the catching protrusion sliding holes 231*c*.

Figure 13B:
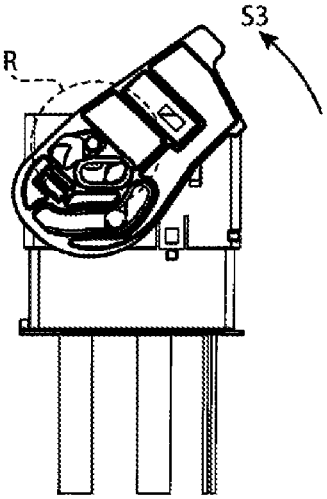
FIG. 13B is a side view of a first step of the operation of unmating the cap connector from the plug connector.
Figure 14:
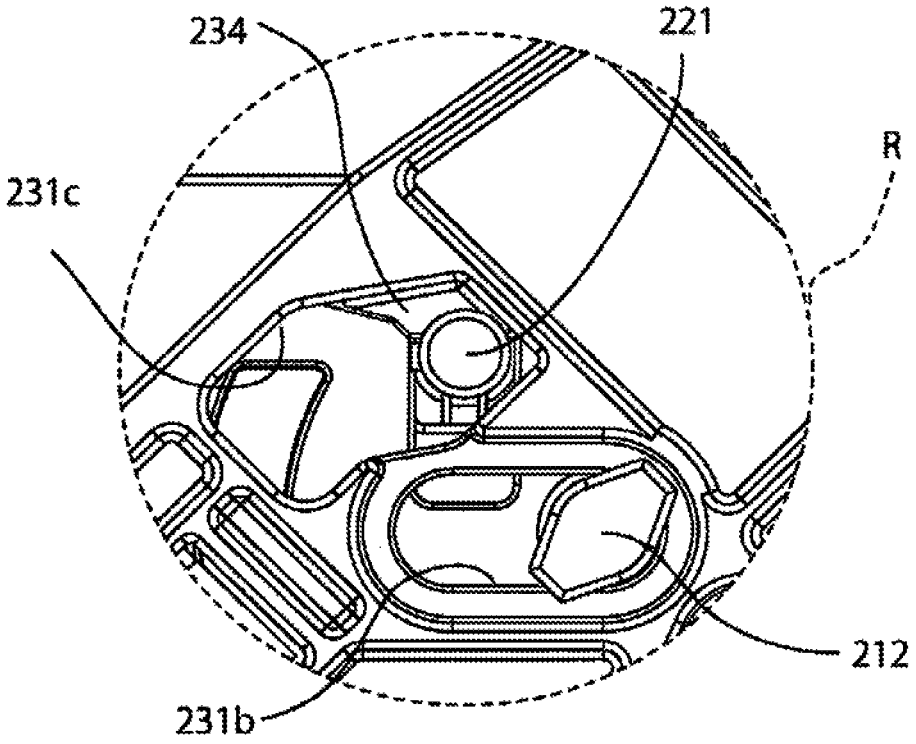
FIG. 14 is a side view of an enlarged portion of FIG. 13B.

From the position of the lever 23 shown in FIG. 13A, the lever 23 is turned by 45 degrees in the direction of the arrow S3 to an attitude of FIG. 13B. FIG. 14 is an enlarged view of a portion indicated by a circle R shown in FIG. 13B. When the lever 23 is turned by 45 degrees in the direction of the arrow S3, the catching protrusion 221 of the inner housing 22 is pushed into a corner of the catching protrusion sliding hole 231*c* of the lever 23, as shown in FIG. 14. In addition, the catching rib 234 of the lever 23 extends into the catching groove 222 provided in the catching protrusion 221. Thereby, the lever 23 can no longer be turned in the direction of the arrow S3. In addition, when the lever 23 is in the 45-degrees inclined attitude, the interlock connector 13 is kept pinched by the clip spring 24. It should be noted that the engagement of the catching rib 234 and the catching groove 222 also functions to prevent the inner housing 22 from popping out.

Figure 13C:
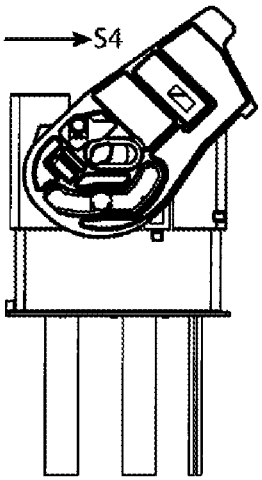
FIG. 13C is a side view of a second step of the operation of unmating the cap connector from the plug connector.

The lever 23 is next slid in the direction of an arrow S4 shown in FIG. 13C. The short circuit of the terminals 12 is removed after a predetermined period of time elapses after the short circuit of the two conducting wires 131 is removed by extracting the interlock busbar 26 from the interlock connector 13. When the lever 23 is slid in the direction of the arrow S4 shown in FIG. 13C, the catching protrusion 221 slides out of the corner of the catching protrusion sliding hole 231*c* of the lever 23 to disengage the catching grooves 222 and the catching rib 234 from each other. Thereby, the lever 23 can now be turned again in the direction of the arrow S3.

Figure 13D:
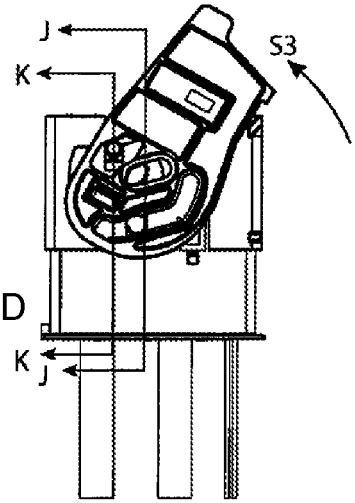
FIG. 13D is a side view of a third step of the operation of unmating the cap connector from the plug connector.
Figure 13E:
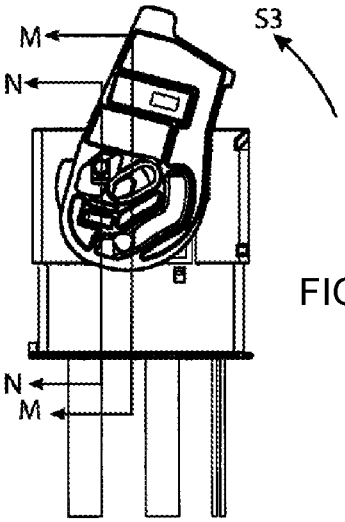
FIG. 13E is a side view of a fourth step of the operation of unmating the cap connector from the plug connector.
Figure 13F:
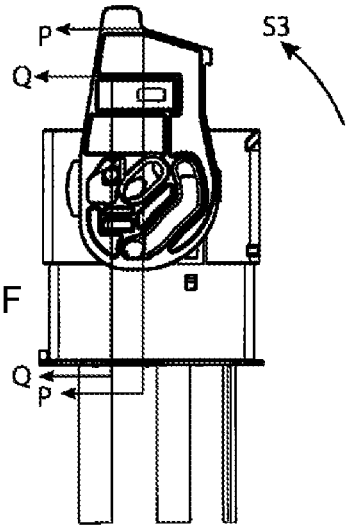
FIG. 13F is a side view of a fifth step of the operation of unmating the cap connector from the plug connector.

The lever 23 reaches the vertically-oriented attitude (a 0-degrees inclined attitude) shown in FIG. 13F from the 45-degrees inclined attitude shown in FIG. 13C through a 30-degrees inclined attitude shown in FIG. 13D and a 15-degrees inclined attitude shown in FIG. 13E.

Figure 15A:
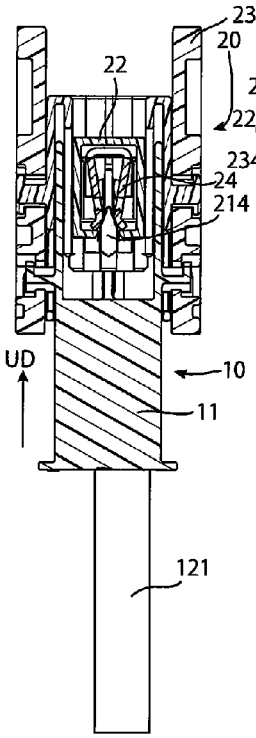
FIG. 15A is a sectional front view of the cap connector and the mating connector in the third step of the operation of unmating taken along line J-J of FIG. 13D.
Figure 15B:
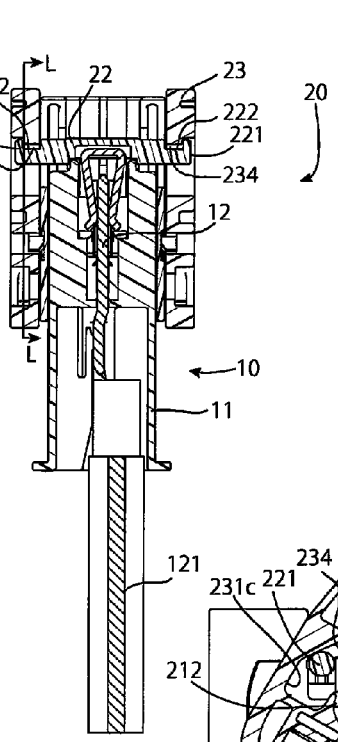
FIG. 15B is a sectional front view of the cap connector and the mating connector in the third step of the operation of unmating taken along line K-K of FIG. 13D.
Figure 15C:
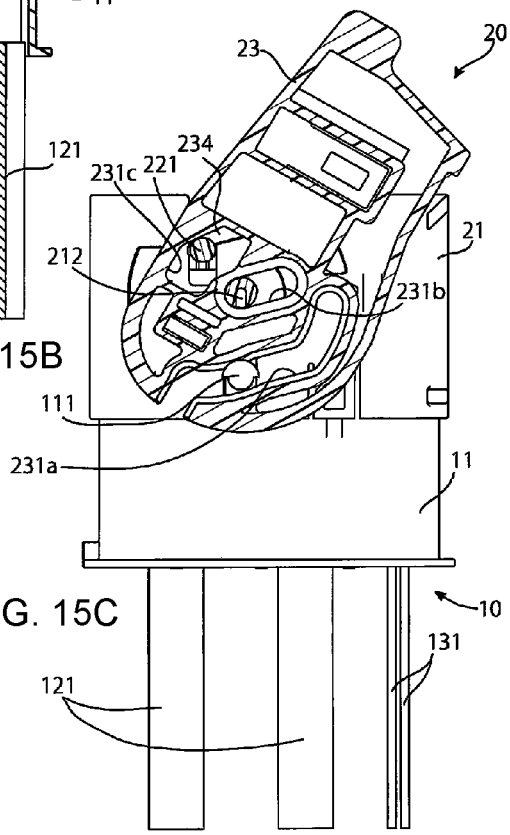
FIG. 15C is a sectional side view of the cap connector and the mating connector in the third step of the operation of unmating taken along line L-L of FIG. 15B.

The internal state of the plug connector 20 when the lever 23 is inclined at 30 degrees is shown in FIGS. 15A-15C; FIG. 15A is a cross-sectional view taken along arrows J-J shown in FIG. 13D and FIG. 15B is a cross-sectional view taken along arrows K-K shown in FIG. 13D. The lever 23 is turned to the 30-degrees inclined attitude shown in FIG. 13D in the direction of the arrow S3. During this turn, the outer housing 21 is pushed up in the unmating direction UD and the releasing protrusions 214 extend into the clip spring 24 to push the clip spring 24 open. The inner housing 22 accommodating the clip spring 24 is lifted along with the outer housing 21 under a force oriented in the direction of the arrow UD. In this state, however, the catching ribs 234 of the lever 23 are located in the catching grooves 222 provided in the catching protrusions 221 of the inner housing 22, as shown in FIGS. 15B and 15C. Accordingly, thereby, the inner housing 22 is not lifted along with the outer housing 21 but held down at that position.

Figures 16A, 16B, 16C:
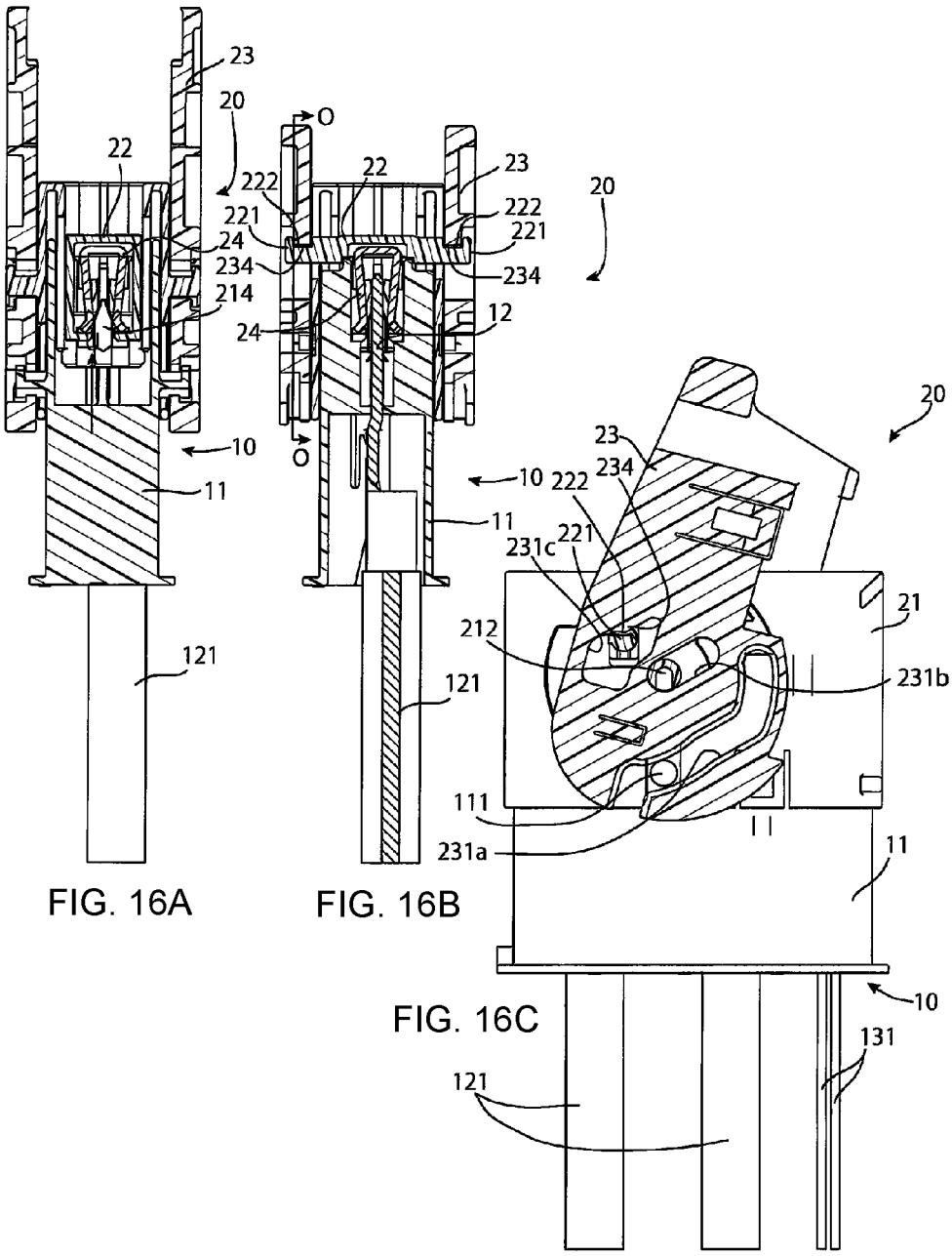
FIG. 16A is a sectional front view of the cap connector and the mating connector in the fourth step of the operation of unmating taken along line M-M of FIG. 13E.
FIG. 16B is a sectional front view of the cap connector and the mating connector in the fourth step of the operation of unmating taken along line N-N of FIG. 13E.
FIG. 16C is a sectional side view of the cap connector and the mating connector in the fourth step of the operation of unmating taken along line O-O of FIG. 16B.

The internal state of the plug connector 20 when the lever 23 is inclined at 15 degrees is shown in FIGS. 16A-16C; FIG. 16A is a cross-sectional view taken along arrows M-M shown in FIG. 13E and FIG. 16B is a cross-sectional view taken along arrows N-N shown in FIG. 13E. The lever 23 is turned to the 15-degrees inclined attitude in the direction of the arrow S3. Thereupon, as compared with when the lever 23 is in the 30-degrees inclined attitude shown in FIGS. 15A-15C, the outer housing 21 is further lifted in the unmating direction UD. However, since the catching ribs 234 are kept in the catching grooves 222, the inner housing 22 is not lifted but keeps its original position. Thereby, the releasing protrusions 214 extend into the clip spring 24 to push the clip spring 24 open.

Figure 17A:
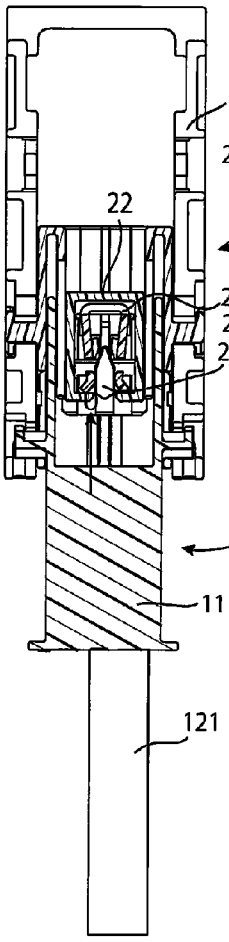
FIG. 17A is a sectional front view of the cap connector and the mating connector in the fifth step of the operation of unmating taken along line P-P of FIG. 13F.
Figure 17B:
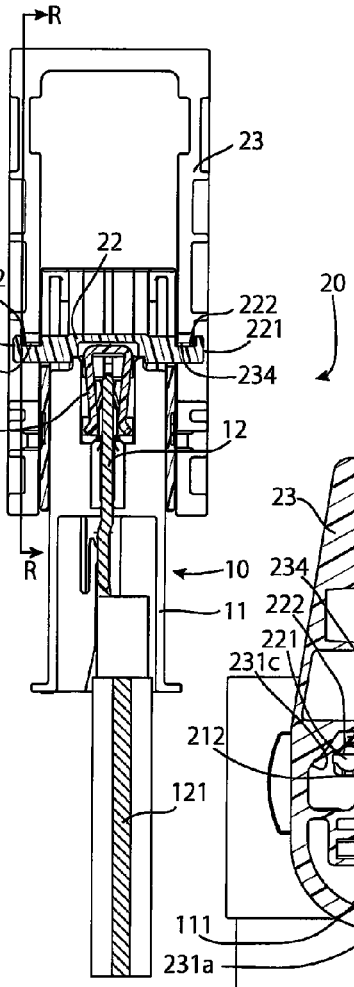
FIG. 17B is a sectional front view of the cap connector and the mating connector in the fifth step of the operation of unmating taken along line Q-Q of FIG. 13F.
Figure 17C:
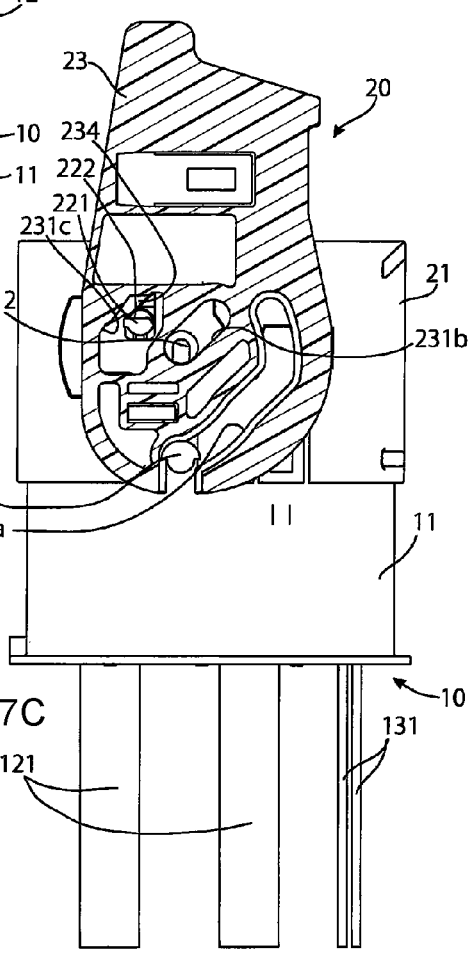
FIG. 17C is a sectional side view of the cap connector and the mating connector in the fifth step of the operation of unmating taken along line R-R of FIG. 17B.

The internal state of the plug connector 20 when the lever 23 has a vertically oriented attitude having a 0 degrees inclination is shown in FIGS. 17A-17C; FIG. 17A is a cross-sectional view taken along arrows P-P shown in FIG. 13F and FIG. 17B is a cross-sectional view taken along arrows Q-Q shown in FIG. 13F. While the lever 23 is being turned from the 15-degrees inclined attitude shown in FIG. 13(E) to the vertically-oriented attitude shown in FIG. 13(F), the catching grooves 222 of the catching protrusions 221 and the catching ribs 234 still continue sliding on each other. Then, with this sliding, the outer housing 21 is further lifted while the inner housing 22 is left behind, and the releasing protrusions 241 push the clip spring 24 open into an unmating state. As described with reference to FIG. 9B, the thickness d1 of the releasing protrusion 214 is thicker than the thickness d2 of the terminal 12. When the lever 23 reaches the vertically-oriented attitude shown in FIG. 13F, the clip spring 24 is pushed open by the releasing protrusion 214 to the same extent as the thickness d1 of the releasing protrusion 214, so that the terminals 12 can now be easily extracted from the clip spring 24.

Figure 18A:
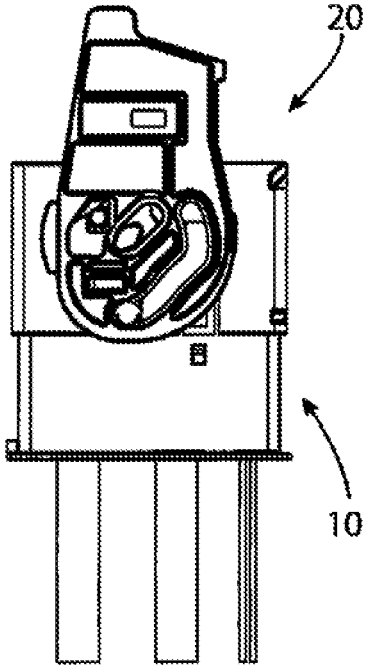
FIG. 18A is a front view of a first part of a final stage of the operation of unmating.
Figure 18B:
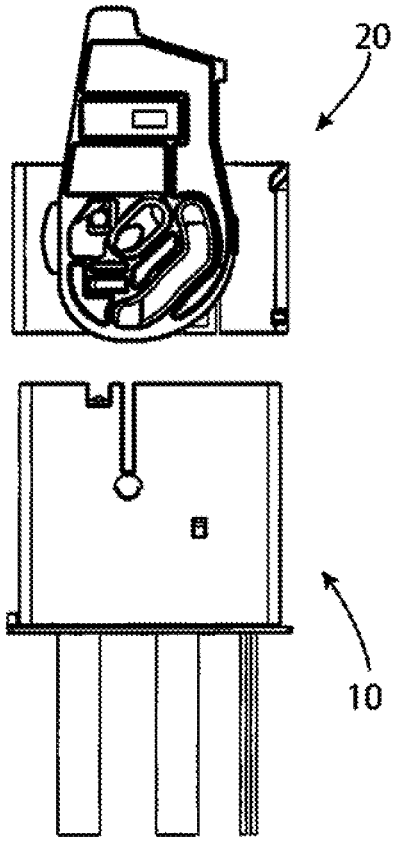
FIG. 18B is a front view of a second part of the final stage of the operation of unmating.

A final stage of the unmating operation is shown in FIGS. 18A and 18B. The plug connector 20 in the state of FIG. 18A is released by the releasing protrusion 214 from the pinching of the terminal 12 with the clip spring 24. Therefore, by lifting the plug connector 20 in the unmating direction UD, the plug connector 20 can be easily unmated from the cap connector 10.

The plug connector 20 has a structure in which the catching protrusions 221 are provided on the inner housing 22 and the lever 23 is turned with the catching protrusions 221 caught in the catching protrusion sliding holes 231*c*. Therefore, a lock mechanism separate from the lever 23 is not required, resulting in improvement in workability, reduction in work time when the plug connector 20 is unmated from the cap connector 10, and size reduction.

What is claimed is:

1. A plug connector detachably matable with a cap connector, the cap connector including an interlock connector retaining a plurality of ends of a pair of first conducting wires, a pair of terminals fixed to a plurality of ends of a pair of second conducting wires, and a mating housing accommodating the interlock connector and the pair of terminals and having a first boss protruding from an outer wall face of the mating housing, the plug connector comprising:

an interlock busbar capable of being inserted into the interlock connector to short-circuit the first conducting wires;

a clip spring adapted to pinch the terminals with a spring force to short-circuit the terminals;

an inner housing retaining the clip spring and having a catching protrusion protruding outward from the inner housing;

an outer housing accommodating and retaining the interlock busbar, accommodating the inner housing retaining the clip spring slidably in a direction of mating with and a direction of unmating from the cap connector, and formed with a releasing protrusion adapted to be positioned in the clip spring to keep the clip spring open when the plug connector is unmated from the cap connector, and having a second boss protruding from an outer wall face of the outer housing; and a lever adapted to be operated to perform mating with and unmating from the cap connector, the lever includes a cam groove for receiving the first boss, a boss rotation hole for receiving the second boss, and a catching protrusion sliding hole for receiving the catching protrusion, a first turning operation of the lever during an unmating operation from a fully mated state with the cap connector causes a short-circuit removing motion extracting the interlock busbar from the interlock connector to remove the short circuit of the first conducting wires, and a second turning operation of the lever during the unmating operation after the short-circuit removing motion causes a spring opening motion moving the releasing protrusion into the clip spring to open the clip spring by moving the outer housing in the direction of unmating while pushing the catching protrusion in the direction of mating to block the inner housing from moving in the direction of unmating.

2. The plug connector of claim 1, further comprising a structure for blocking a turning of the lever when the first turning operation of the unmating operation is ended.

3. The plug connector of claim 2, wherein the structure unblocks the turning of the lever by a sliding operation of the lever to allow the lever to perform the second turning operation of the unmating operation.

4. The plug connector of claim 1, wherein the lever releases the releasing protrusion from the clip spring to pinch the terminals with the clip spring and short circuit the terminals by moving the outer housing in the direction of mating while the inner housing remains abutting the mating housing.

5. The plug connector of claim 4, wherein the lever releases the releasing protrusion from the clip spring with the first turning operation during a mating operation of the lever after a mating initiating operation receiving the terminals in the clip spring opened by the releasing protrusion.

6. The plug connector of claim 5, wherein the lever causes an insertion of the interlock busbar into the interlock connector to short circuit the first conducting wires with the second turning operation during the mating operation.

7. The plug connector of claim 6, wherein the second turning operation during the mating operation occurs after the first turning operation during the mating operation.

8. The plug connector of claim 7, further comprising a structure for blocking a turning of the lever when the first turning operation of the mating operation is ended.

9. The plug connector of claim 8, wherein the structure unblocks the turning of the lever by a sliding operation of the lever to allow the lever to perform the second turning operation of the mating operation.

10. A connector assembly, comprising:

a cap connector including an interlock connector retaining a plurality of ends of a pair of first conducting wires, a pair of terminals fixed to a plurality of ends of a pair of second conducting wires, and a mating housing accommodating the interlock connector and the pair of terminals and having a first boss protruding from an outer wall face of the mating housing; and a plug connector detachably matable with the cap connector and including:

an interlock busbar capable of being inserted into the interlock connector to short-circuit the first conducting wires;

a clip spring adapted to pinch the terminals with a spring force to short-circuit the terminals;

an inner housing retaining the clip spring and having a catching protrusion protruding outward from the inner housing;

an outer housing accommodating and retaining the interlock busbar, accommodating the inner housing retaining the clip spring slidably in a direction of mating with and a direction of unmating from the cap connector, and formed with a releasing protrusion adapted to be positioned in the clip spring to keep the clip spring open when the plug connector is unmated from the cap connector, and having a second boss protruding from an outer wall face of the outer housing; and a lever adapted to be operated to perform mating with and unmating from the cap connector, the lever includes a cam groove for receiving the first boss, a boss rotation hole for receiving the second boss, and a catching protrusion sliding hole for receiving the catching protrusion, a first turning operation of the lever during an unmating operation from a fully mated state with the cap connector causes a short-circuit removing motion extracting the interlock busbar from the interlock connector to remove the short circuit of the first conducting wires, and a second turning operation of the lever during the unmating operation after the short-circuit removing motion causes a spring opening motion moving the releasing protrusion into the clip spring to open the clip spring by moving the outer housing in the direction of unmating while pushing the catching protrusion in the direction of mating to block the inner housing from moving in the direction of unmating.

* * * * *